US009657662B2

(12) United States Patent
Bolz et al.

(10) Patent No.: US 9,657,662 B2
(45) Date of Patent: May 23, 2017

(54) DETERMINATION OF THE QUANTITY OF FUEL FLOWING THROUGH A FUEL INJECTOR BASED ON THE HEATING OF THE FUEL BY MEANS OF AN ELECTRIC HEATING DEVICE

(71) Applicant: CONTINENTAL AUTOMOTIVE GMBH, Hannover (DE)

(72) Inventors: Stephan Bolz, Pfatter (DE); Martin Goetzenberger, Ingolstadt (DE)

(73) Assignee: Continental Automotive GmbH, Hannover (DE)

( * ) Notice: Subject to any disclaimer, the term of this patent is extended or adjusted under 35 U.S.C. 154(b) by 182 days.

(21) Appl. No.: 14/490,901

(22) Filed: Sep. 19, 2014

(65) Prior Publication Data

US 2015/0090230 A1 Apr. 2, 2015

(30) Foreign Application Priority Data

Sep. 19, 2013 (DE) ..... 10 2013 218 841

(51) Int. Cl.
*F02D 41/00* (2006.01)
*F02D 41/40* (2006.01)
(Continued)

(52) U.S. Cl.
CPC ..... *F02D 41/0085* (2013.01); *F02D 37/00* (2013.01); *F02D 41/401* (2013.01);
(Continued)

(58) Field of Classification Search
CPC ..... F02D 2200/0606; F02D 2200/0616; F02D 37/00; F02D 41/0085; F02D 41/2464;
(Continued)

(56) References Cited

U.S. PATENT DOCUMENTS 5,587,091 A * 12/1996 Kawagoe ..... B23K 11/257 219/110
5,796,076 A * 8/1998 Azuma ..... A61H 33/063 219/484
(Continued)

FOREIGN PATENT DOCUMENTS

DE 19952344 A1 5/2001
DE 102007028900 A1 12/2008
DE 102011085082 B3 2/2013

OTHER PUBLICATIONS

160510 DE19952344 machine translation.PDF.*

*Primary Examiner* — Carlos A Rivera
*Assistant Examiner* — Carl Staubach
(74) *Attorney, Agent, or Firm* — Laurence A. Greenberg; Werner H. Stemer; Ralph E. Locher

(57) ABSTRACT

A method for determining the quantity of fuel flowing through a fuel injector. The fuel injector has an electric heating device for heating the fuel and a temperature-measuring device for measuring the temperature of the heated fuel. The method includes (a) applying a predetermined electrical heating power to the electric heating device, (b) measuring an increase in the temperature of the fuel as a consequence of the heating power, and (c) determining the quantity of fuel flowing through the fuel injector on the basis of the applied electrical heating power and the measured increase in the temperature. A method for equalizing the fuel feed at at least two cylinders of an internal combustion engine utilizes the method for determining the quantity of fuel flowing through a fuel injector. An engine controller and a computer program carry out the specified methods.

10 Claims, 3 Drawing Sheets

(51) Int. Cl.

| | |
|---|---|
| ***F02M 69/52*** | (2006.01) |
| ***F02D 37/00*** | (2006.01) |
| *F02M 53/06* | (2006.01) |
| *F02D 41/24* | (2006.01) |

(52) U.S. Cl.

CPC ..... *F02M 69/52* (2013.01); *F02D 41/2464* (2013.01); *F02D 41/2467* (2013.01); *F02D 41/40* (2013.01); *F02D 2200/0606* (2013.01); *F02D 2200/0616* (2013.01); *F02M 53/06* (2013.01)

(58) Field of Classification Search

CPC .... F02D 41/2467; F02D 41/40; F02D 41/401; F02D 2200/0614; F02D 2200/0602; F02M 53/06; F02M 69/52

USPC ..... 701/103, 104, 105, 113; 123/435, 445, 123/464, 472, 480, 490, 491, 494, 549, 123/550, 557, 558, 673, 685, 686, 691; 73/114.45, 114.48, 114.49

See application file for complete search history.

(56) References Cited

U.S. PATENT DOCUMENTS

| | | | | |
|---|---|---|---|---|
| 8,333,109 | B2 | 12/2012 | Migueis et al. | |
| 9,328,681 | B2 * | 5/2016 | Takada | F02D 41/0085 |
| 9,334,843 | B2 * | 5/2016 | Czimmek | F02M 53/06 |
| 2008/0027624 | A1 * | 1/2008 | Kloos | F02D 41/3836 701/103 |
| 2010/0108540 | A1 * | 5/2010 | Kato | G01N 27/4067 205/781 |
| 2011/0276252 | A1 | 11/2011 | Kabasin et al. | |
| 2012/0109497 | A1 * | 5/2012 | Anzawa | F02D 41/22 701/103 |
| 2012/0191325 | A1 * | 7/2012 | Haskara | F02D 35/023 701/104 |
| 2012/0285424 | A1 * | 11/2012 | Mowery | F02M 53/06 123/549 |
| 2013/0275025 | A1 * | 10/2013 | Isenberg | F02M 53/06 701/103 |
| 2014/0251275 | A1 * | 9/2014 | Lana | F02M 63/0225 123/452 |
| 2015/0377167 | A1 * | 12/2015 | Flohr | F02D 41/1446 701/104 |

* cited by examiner

DETERMINATION OF THE QUANTITY OF FUEL FLOWING THROUGH A FUEL INJECTOR BASED ON THE HEATING OF THE FUEL BY MEANS OF AN ELECTRIC HEATING DEVICE

BACKGROUND OF THE INVENTION

Field of the Invention

The present invention relates generally to the technical field of the injection of fuel into a combustion chamber or an intake section of an internal combustion engine. The present invention relates, in particular, to a method for determining the quantity of fuel flowing through a fuel injector, wherein the fuel injector has an electric heating device for heating the fuel and a temperature-measuring device for measuring the temperature of the heated fuel. The present invention also relates to a method for equalizing the feeding in of fuel at at least two cylinders of an internal combustion engine, wherein the method described above is applied in order to determine the quantity of fuel flowing through a fuel injector. Furthermore, the present invention relates to an engine controller and to a computer program for carrying out the specified methods.

The feeding of fuel into the combustion chamber of internal combustion engines is typically carried out by means of injection valves which are also referred to as fuel injectors. The fuel which is to be injected is kept ready with an increased pressure at the inlet of the fuel injectors by means of a pump. The fuel quantity is metered in a known fashion over the time period of the opening of the fuel injector. A superordinate closed-loop control means in an engine control device determines this opening period and therefore the fuel quantity metered to the respective cylinder of the internal combustion engine in such a way that, together with the air mass flowing in through a throttle valve, a stoichiometric mixture of air and fuel (gas) is produced in the respective combustion chamber of the internal combustion engine. The exhaust gas which is produced as a result of the combustion can be freed of pollutants in a subsequent catalytic converter only if the injected fuel is burnt completely without excess fuel or oxygen.

Although this superordinate closed-loop control means ensures correct conditioning of the fuel/air mixture in the entirety of the cylinders of the internal combustion engine, the superordinate closed-loop control means cannot, however, compensate or regulate any cylinder-specific differences in the metering of fuel, with the result that it is not possible to perform what is referred to as equalization of the combustion processes in the individual cylinders of the internal combustion engine. Such differences can be produced, for example, by means of individually different opening and closing times of the fuel injectors and/or by means of differences in the fuel through flow rate through the fuel injectors. Although such fabrication-related fluctuations in the fuel injectors can be limited given precise control of the fabrication, they are in principle unavoidable.

A known method for equalizing the metering of fuel consists in measuring the exhaust gas of each individual cylinder by means of a oxygen fuel probe (referred to as a linear lambda probe) and individually adapting the opening times and closing times of the fuel injectors on the basis thereof. Such a linear lambda probe can measure the concentration of the residual oxygen in the exhaust gas over a wide range, in contrast to the widespread step-change lambda probe. The output signal of the step-change lambda probe has, in contrast, an approximately digital behavior from a high to a low voltage level in the region of the stoichiometric combustion. However, the known method for equalizing the metering of fuel is complex and very expensive owing to the required special oxygen probe and an additionally necessary measuring and closed-loop control device.

BRIEF SUMMARY OF THE INVENTION

The present invention is based on the object of specifying a method with which a through-flow of fuel through a fuel injector can be determined individually. The present invention is also based on the object of specifying an easy-to-carry-out method for equalizing the feeding in of fuel at at least two cylinders of an internal combustion engine.

These objects are achieved by means of the subject matters of the independent patent claims. Advantageous embodiments, further features and details of the present invention can be found in the dependent claims, the description and the drawing. In this context, features and details which are described in relation to the method also apply, of course, in relation to the engine controller and the computer program, and respectively vice versa, with the result that with respect to the disclosure of this invention it is always possible to refer to the individual aspects of the invention in a reciprocal fashion.

According to a first aspect of the invention, a method for determining the quantity of fuel flowing through a fuel injector is described, wherein the fuel injector has an electric heating device for heating the fuel and a temperature-measuring device for measuring the temperature of the heated fuel. The described method comprises (a) applying a predetermined electrical heating power to the electric heating device, (b) measuring an increase in the temperature of the fuel as a consequence of the heating power, and (c) determining the quantity of fuel flowing through the fuel injector on the basis of the applied electrical heating power and the measured increase in the temperature.

The described method is based on the realization that the fuel which flows through the fuel injector picks up thermal energy from the heating device and as a result the temperature of the fuel rises. In this context it is, of course, possible for a larger quantity of fuel to take up a larger quantity of heat, owing to relatively high thermal capacity, than a relatively small quantity of fuel with a relatively low thermal capacity. In other words, given a specific predefined quantity of heat, a relatively small quantity of fuel heats up more strongly than a relatively large quantity of fuel. Considered in dynamic terms, given a predefined heating power (i.e. quantity of heat over time), a relatively high mass flow (i.e. fuel mass which flows through the fuel injector per unit of time), heats up less strongly than a relatively low mass flow. Therefore, if the heating power and the increase in temperature of the fuel flowing through the fuel injector (in a pulsed form) is known, the mass flow of fuel can be determined by considering the specific thermal capacity of the fuel, using the following formula (1):

$$P=c_p\cdot\Delta T\cdot\dot{m} \tag{1}$$

Here, P is the electrical heating power in watts. The electrical heating power can be, for example, 200 W.

The parameter $c_p$ stands for the specific thermal capacity of the fuel used. The unit of $c_p$ is Ws/(kg·K). For example, for the fuel ethanol the following applies: $c_{P_Ethanol}$=2430 Ws/(kg·K).

$\Delta T$ is the temperature difference of the fuel between the forward run to the fuel injector and the outlet of the fuel from the fuel injector. The unit of $\Delta T$ is Kelvin. The temperature difference $\Delta T$ can in practice be, for example, 75K.

$\dot{m}$ or dm/dt is the mass flow of the fuel flowing through the fuel injector. The unit of the fuel mass flow is kg/s. The fuel mass flow can be, for example, 0.001 kg/s or 1 g/s.

The heating power P can be transferred to the fuel located in the fuel injector by means of ohmic heating and/or by means of inductive heating.

It is to be noted that this equation applies only to the case of a steady state. Therefore, if, for example, shortly after the start of the operation of the internal combustion engine the heating power is used not only to heat the fuel but also to heat the fuel injector, equation (1) cannot be used to determine the fuel mass flow. However, if the operating temperature of the fuel injector is reached in the steady state, the heating power is used at least approximately only to heat up the fuel flowing through the fuel injector, and the fuel mass flow can be described in a very good approximation with the equation (1).

At this point, it is also to be noted that good thermal isolation between the fuel injector and the internal combustion engine can contribute to the state of thermal equilibrium of the fuel injector being reached quickly. The fuel injector is accordingly preferably a attached to the inner wall of an air intake section of the internal combustion engine by means of a thermally well insulating securing element, in particular a plastic securing element.

The described method can be used particularly advantageously in spark ignition engines which are operated with a fuel which has a high proportion of bioethanol. For spark ignition engines which are also to be operated with bioethanol (referred to as FlexFuel vehicles), in fact a system for fuel heating has been developed which is intended to ensure a reliable start even at low temperatures. In this context, as described for example in DE 10 2011 085 082 B3, a metallic body of the fuel injector is heated by means of an ohmic or inductive principle of action, which leads in turn to heating of the through-flowing fuel. This heating system is operated by means of a closed-loop control means which is based on a microprocessor, wherein both power fed to the electric heating device and the resulting increase in temperature is detected individually for each fuel injector. Knowledge of the temperature increase which is achieved and of the fed-in heating power permits the fuel mass flow through the fuel injector to be determined using the equation (1).

According to one exemplary embodiment of the invention, the increase in the temperature of the fuel is measured by means of the electric heating device. This has the advantage that there is no need for a separate temperature-measuring device which is integrated into the fuel injector in order to carry out the method described here. Instead, the method described here can be carried out with known fuel injectors which, however, must have the heating device described above.

The heating device can have, for example, an ohmically resistive conductor which is used on the one hand for ohmic or, if appropriate, inductive heating of the fuel flowing through the fuel injector and which represents, on the other hand, a temperature-measuring probe whose ohmic resistance depends on the temperature thereof and therefore on the quantity of thermal energy which can be output per time unit to the fuel flowing through the fuel injector.

According to a further aspect of the invention, a method for equalizing the feeding in of fuel at least two cylinders of an internal combustion engine is described. This method comprises (a) carrying out the method described above for each of the fuel injectors which are respectively assigned to a cylinder of the internal combustion engine, and (b) balancing the feeding in of fuel on the basis of the specific quantities of fuel.

The described cylinder equalization method is based on the realization that differences relating to the mass feeding in of fuel between various cylinders can be determined with the method described above during operation of the internal combustion engine and can be at least partially compensated on the basis of this determination.

Expressed in figurative terms, this means that differences in the mass metering of fuel of fuel injectors can be detected effectively on the basis of information on functioning devices which are already available in the motor vehicle, and these differences can be at least partially compensated by suitable actuation of a fuel injection system. A significant advantage of the method described here is that use of the otherwise necessary and very expensive linear lambda probes can be dispensed with. The differences in the mass metering of fuel determined with the method according to the invention can be used subsequent to the improvement in the cylinder equalization. This permits both an improvement in the smooth running of the engine and a reduction in the raw emissions of pollutants. Lower raw emissions of pollutants in turn permit the storage capacity of the catalytic converter to be reduced, with the result that the use of a smaller and therefore more cost-effective catalytic converter becomes possible.

The specified internal combustion engine can be, in particular, a spark ignition engine in which the fuel/air mixture introduced into a combustion chamber is externally ignited by means of a spark plug, for example. However, the described method can also be executed with an auto-igniting internal combustion engine, in particular with a diesel engine.

According to one exemplary embodiment of the invention, the balancing of the feeding in of fuel comprises adapting the opening times and/or closing times of the respective fuel injector.

Adapting the actuation times of at least some of the fuel injectors has the advantage that the fuel mass flow through the respective fuel injector can easily be set to a certain value which brings about equalization of the feeding in of fuel through the various fuel injectors.

According to a further exemplary embodiment of the invention, the method also comprises determining the predetermined electrical heating power for each fuel injector of the internal combustion engine, with the result that a thermal heating power which, in the case of a specific fuel mass flow through the respective fuel injector, is transferred to the fuel flowing through the fuel injector, is the same for all the fuel injectors.

As a result of the determination, described here, of the electrical heating power which is predetermined for each fuel injector, statistical and/or dynamic fluctuations or properties of the energy transfer from the respective heating device to the fuel flowing through the respective fuel injector as well as losses as a result of outputting of thermal energy to the surroundings can be determined and compensated by a suitable selection of the respective predetermined electrical heating power. No additional expenditure on equipment at all is advantageously necessary in order to determine these influences on the thermal energy transfer or power transfer from the respective heating device to the fuel flowing through the fuel injector.

According to a further exemplary embodiment of the invention, the determination of the predetermined electrical heating power for each fuel injector of the internal combustion engine comprises (a) closing the fuel injector, (b) measuring the temperature of the fuel located in the fuel injector, (c) feeding in, with the fuel injector closed, a predefined test heating power until the measured temperature of the fuel located in the fuel injector has reached a predefined setpoint temperature, (d) measuring the time period which was necessary in order to reach the predefined setpoint temperature at the predefined test heating power, and (e) determining the predetermined electrical heating power on the basis of the measured time period.

With the procedure described here for determining the electrical heating power which is predetermined individually for each fuel injector it is easily and effectively possible to adjust with respect to one another the heating devices which are assigned to different fuel injectors. In this case, the respectively measured time period determines the predetermined electrical heating power in such a way that, for a fuel injector in which a relatively long time period is necessary in order to adjust the fuel injector or the fuel located in the fuel injector to the predefined setpoint temperature, the predetermined electrical heating power has to be raised to a higher value than for a fuel injector in which this time period is relatively short. In this way, different thermal efficiency levels of the various heating devices with respect to the heating up of the fuel injector or of the fuel located in the fuel injector as well as inaccuracies of the power-measuring device can be compensated or adjusted.

According to a further exemplary embodiment of the invention, the determination of the predetermined electrical heating power for each fuel injector of the internal combustion engine is carried out at a time after the internal combustion engine was not operational for at least one specific rest time.

The determination of the respective predetermined electrical heating power after a certain minimum stationary time of the internal combustion engine has the advantage that it can be assumed that the entire internal combustion engine has cooled down to such an extent that the temperature of the fuel which is located in the closed fuel injector at the start of the feeding in of the test heating power is equal to the oil temperature of the internal combustion engine. As a result, through a simple measurement of the oil temperature, which can typically occur with an oil-temperature-measuring device which is present in almost in all motor vehicles anyway, it is possible to measure the temperature of the fuel which is located in the closed fuel injector at the start of the feeding in of the test heating power.

According to a further exemplary embodiment of the invention, the predefined test heating power is adjusted to a specific value. In this way, the electrical heating power which is predetermined individually for each fuel injector can easily be determined with particularly high accuracy.

According to a further aspect of the invention, an engine controller for an internal combustion engine is described. This engine controller is configured in such a way that the method described above can be executed in order to determine the quantity of fuel flowing through a fuel injector and/or the method which is also described above can be executed in order to equalize the feeding in of fuel at at least two cylinders of the internal combustion engine.

In this context, it is to be noted that the described engine controller can also interact with other components of the internal combustion engine or of a motor vehicle in order to execute a number of method steps of the methods described here. The engine controller can thus interact, for example, with an output stage for applying a predetermined electrical heating power to the electric heating device, and/or with a temperature-measuring device for measuring the increase in the temperature of the fuel as a result of the heating power.

According to a further aspect of the invention, a computer program for determining the quantity of fuel flowing through a fuel injector is described. The computer program, when executed by a processor, is configured to carry out one of the methods described above.

According to this document, the specification of such a computer program is equivalent to the term of a program element, of a computer program product and/or of a computer-readable medium which contains instructions for the control of a computer system in order to coordinate the method of operation of a system or of a method in a suitable way, in order to bring about the effects linked with the method according to the invention.

The computer program can be implemented as a computer-readable instruction code in any suitable programming language such as, for example, in JAVA, C++ etc. The computer program can be stored on a computer-readable storage medium (CD-Rom, DVD, Blue-ray Disk, removable disk drive, volatile or non-volatile memory, built-in memory or processor, etc.). The instruction code can program a computer or other programmable devices such as, in particular, a control unit for an internal combustion engine of a motor vehicle in such a way that the desired functions are executed. In addition, the computer program can be made available in a network such as, for example, the Internet from which it can be downloaded by a user when necessary.

The invention can be implemented both by means of a computer program, i.e. by means of software, as well as by means of one or more special electrical circuits, i.e. in the form of hardware or else in any desired hybrid form, i.e. by means of software components and hardware components.

It is to be noted that embodiments of the invention have been described with respect to different inventive subject matters. In particular, a number of embodiments of the invention are described with method claims and other embodiments of the invention with device claims. However, it will become immediately clear to a person skilled in the art on reading this application that, unless explicitly stated otherwise, in addition to a combination of features which are associated with one type of inventive subject matter, any desired combination of features which are associated with different types of inventive subject matters is also possible.

BRIEF DESCRIPTION OF THE SEVERAL VIEWS OF THE DRAWINGS

Further advantages and features of the present invention can be found in the following exemplary description of currently preferred embodiments. In the drawing.

DESCRIPTION OF THE INVENTION

It is to be noted that the embodiments described below merely represent a restricted selection of possible embodiment variants of the invention. In particular, it is possible to combine the features of individual embodiments with one another in a suitable way, with the result that the embodiment variants which are presented explicitly here are to be considered as disclosing a multiplicity of various embodiments in an obvious way to a person skilled in the art.

Figure 1:
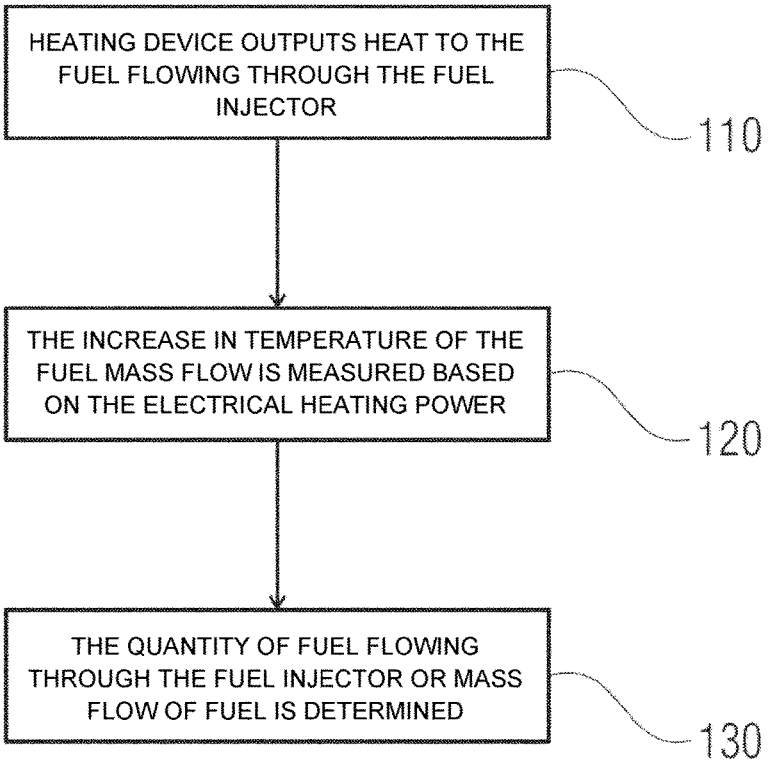
FIG. 1 illustrates, according to an exemplary embodiment of the invention, a method for determining the quantity of fuel flowing through a fuel injector.

FIG. 1 illustrates, according to an exemplary embodiment of the invention, a method for determining the quantity of fuel flowing through a fuel injector. In this context, a fuel injector is used which has an electric heating device for heating the fuel and a temperature-measuring device for measuring the temperature of the heated fuel.

In a first step 110 of the method described here, a predetermined electrical heating power is applied to the electric heating device. As a result of this, the electric heating device outputs heat to the mass flow of fuel flowing through the fuel injector.

In a second step 120, the increase in temperature, based on the electrical heating power, of the fuel mass flow is measured.

In a third step 130, the quantity of fuel flowing through the fuel injector or the mass flow of fuel is determined on the basis of the applied electrical heating power and the measured increase in the temperature. For this purpose, according to the exemplary embodiment represented here, the formula (1) already specified above is used:

$$P=c_p\cdot\Delta T\cdot\dot{m} \tag{1}$$

Where:

P[W] is the heating power of for example 200 Watt $$c_p\left[\frac{Ws}{\mathrm{kg}\cdot K}\right]$$

is the specific thermal capacity of the fuel

ΔT [K] is the temperature difference in the fuel between the forward run and the outflow of the electric heating device or of the electric heater (for example 75 K) and $$\dot{m}\left[\frac{\mathrm{kg}}{\mathrm{s}}\right]$$

is the mass flow of the fuel (for example 0.001 kg/s or 1 g/s)

The differences in the mass/volume flow which are observed for each fuel injector with respect to the other fuel injectors can subsequently be used to improve the accuracy of the metering by adapting the individual actuation times of a solenoid valve of the fuel injector.

It can be observed that the temperature of the heater and the power of the heater are still not a direct measure of the mass flow through the respective fuel injector. In order to determine said mass flow, additional information is required, for example the fuel-forward run temperature, statistical and dynamic properties of the energy transfer from the heater to the fuel as well as losses as a result of outputting of energy to the surroundings, which can never be entirely avoided. However, this does not require any additional expenditure whatsoever.

After a relatively long stationary time of the internal combustion engine or of the associated vehicle, the oil temperature and the fuel temperature become equalized to such an extent that the value of the oil temperature can be used as a fuel forward run temperature.

The mechanism of the energy transfer from the heater to the fuel is very stable, with the result that in practice one determination during a development phase is sufficient to generate a sufficiently accurate behavior model of the thermal energy transfer from the heater or the heating device to the fuel flowing through the fuel injector. This model, which is also referred to for short as the heater model in this document, can then be used in the vehicle for precisely determining the fuel temperature and the heating power which is input.

Furthermore, after a relatively long stationary time of the internal combustion engine, the first heating phase can be used to adjust the various heaters which are respectively assigned to a fuel injector.

According to the exemplary embodiment explained here, in this heating phase a predefined, regulated heating power $P_{manip1\ldots4}$ is fed in to the heater with the fuel injector closed, until a setpoint temperature is reached. Observing the individual time periods until the setpoint temperature is reached permits a comparison between the various heaters.

$$E_{manip1\ldots4}=t_{1\ldots4}\cdot P_{manip1\ldots4} \tag{2}$$

In the equation (2) the following applies:

$E_{manip1\ldots4}$ [Ws]=manipulated value of the energy of the heaters 1 . . . 4

$t_{1\ldots4}$ [s]=heating time period of the heaters 1 . . . 4

$P_{manip1\ldots4}$ [W]=manipulated value of the power of the heaters 1 . . . 4

The (thermal) masses of the heater/fuel injector and the fuel located in the fuel injector fluctuate only to a minimum degree. Likewise, the change in temperature in all the heaters is detected by similar observation paths, with the result that hardly any differences can be observed here either.

$$E_{calc1\ldots4}=\Delta T_1\cdot(c_{p1}\cdot m_1+c_{p2}\cdot m_2)=\mathrm{const} \tag{3}$$

In the equation (3) the following applies:

$E_{calc1\ldots4}$ [Ws]=computational actual value of the energy of the heaters 1 . . . 4

$$c_{p1}\left[\frac{Ws}{\mathrm{kg}\cdot K}\right]=\text{specific thermal capacity of the fuel(for example ethanol)}$$

$$c_{p2}\left[\frac{Ws}{\mathrm{kg}\cdot K}\right]=\text{specific thermal capacity of the fuel injector(substantially steel)}$$

$\Delta T_1$ [K]=temperature difference during the heating process $m_1$ [kg]=mass of the fuel in the fuel injector $m_2$ [kg]=mass of the body of the fuel injector Correspondingly, the heating time periods $t_1$, $t_2$, $t_3$ and $t_4$, of the individual fuel injectors are actually intended to be identical. However, in fact in practice these heating time periods $t_{1\ldots4}$ actually differ, which is essentially due to differences in the heating power which is actually present at the heater.

A mean value $t_{avg}$ of the individual heating time periods $t_{1\ldots4}$ can be determined from the measured heating time periods $t_{1\ldots4}$. The deviations from the mean value $t_{avg}$ then permit the actual heating power of the heaters of the individual fuel injectors to be determined—referred to a mean value—within the scope of a standardization process.

$$t_{avg} = \sum t_{1\ldots4} \div 4 \tag{4}$$

$$P_{stand1\ldots4} = \frac{t_{avg}}{t_{1\ldots4}} \cdot P_{manip1\ldots4} \tag{5}$$

These standardized heating powers can then be used for more precise determination of the various fuel mass flows (and therefore of the volume flows) by the fuel injector.

$$P_{stand1\ldots4} = c_p \cdot \Delta T \cdot \dot{m}_{1\ldots4} \tag{6}$$

Figure 2:
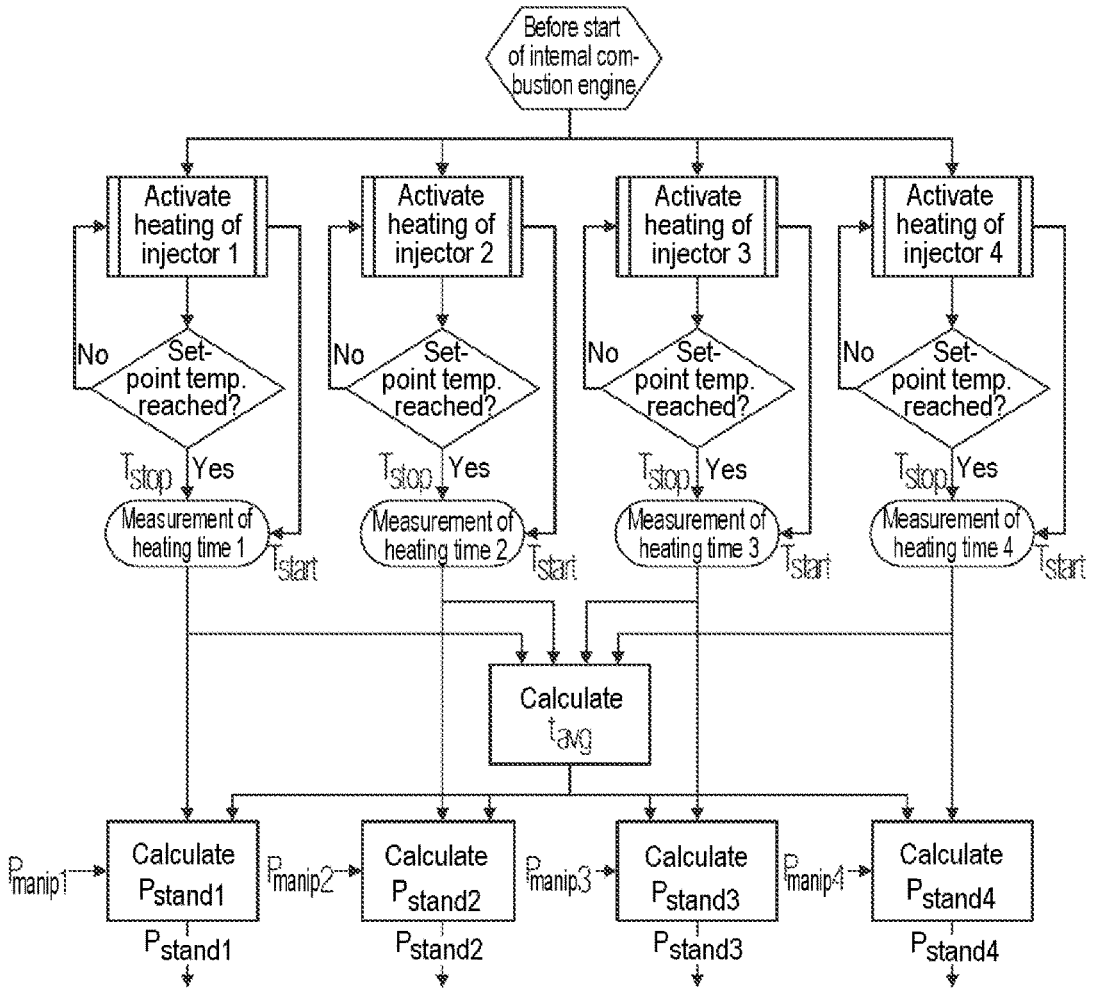
FIG. 2 illustrates, in the form of a flowchart for a four-cylinder engine, a procedure for standardizing the predetermined electrical heating power for four electric heating devices which are each assigned to a fuel injector.

FIG. 2 illustrates, in the form of a flowchart for a four-cylinder engine, a procedure for standardizing the predetermined electrical heating power for four electric heating devices which are respectively assigned to a fuel injector. During this standardization procedure, the corresponding heater with a predefined test heating power is operated for each fuel injector with the fuel injector closed before the start of the internal combustion engine (BKM) and that time period (heating time) until a predefined setpoint temperature is reached is determined. An average heating time period $t_{avg}$ is determined from the specific heating time periods. Then, the standardized heating power $P_{1\ldots4stand}$ is calculated for each heater using equation (5), on the basis of the average heating time period $t_{avg}$, the previously measured heating time period and the predefined, regulated heating power $P_{manip1\ldots4}$ which is used during the heating process.

It is to be noted that the bottom line of the flowchart illustrated in FIG. 2 can in practice be run through repeatedly in the form of an iterative optimization.

Figure 3:
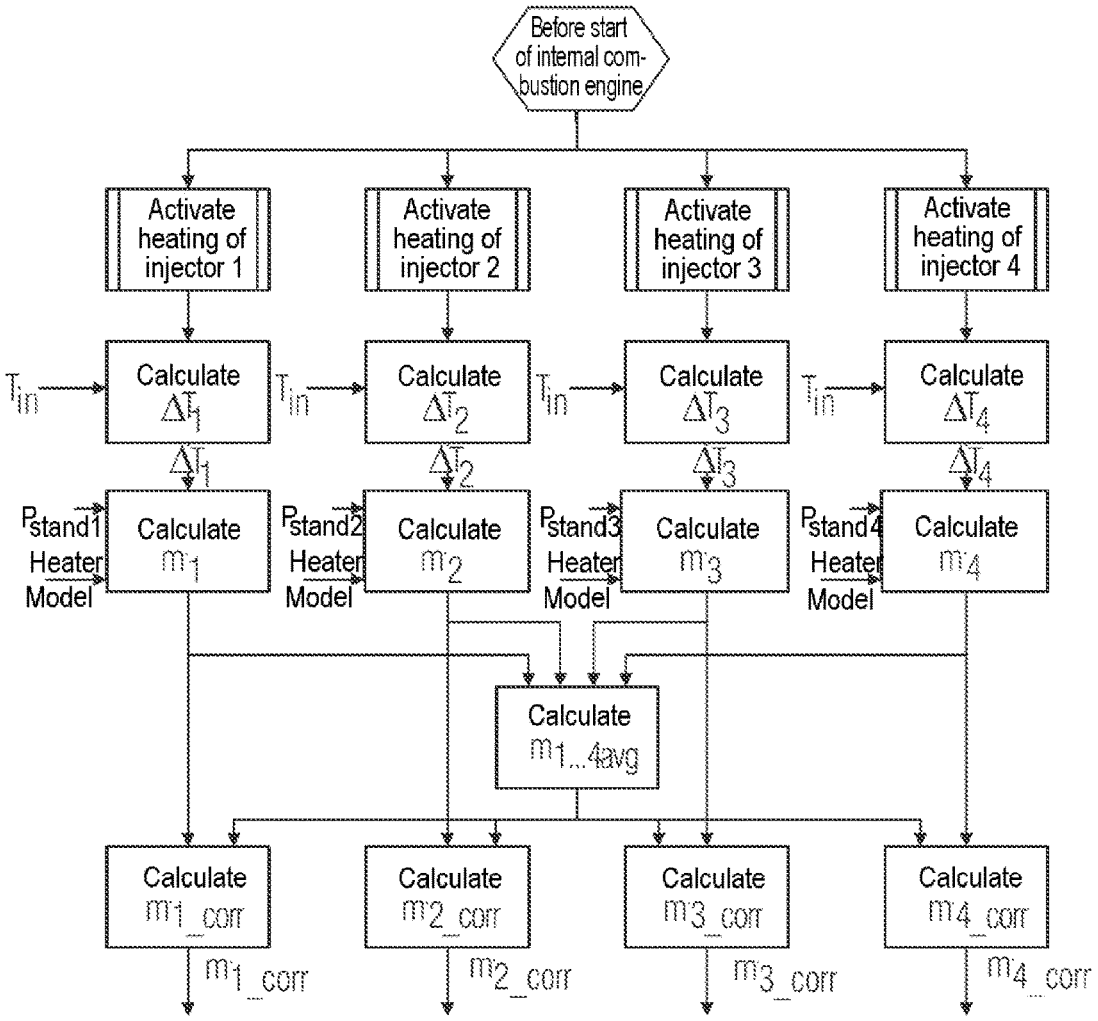
FIG. 3 illustrates, in the form of a flowchart for a four-cylinder engine, a method for determining the correction values, necessary for cylinder equalization, for the metering of fuel for each individual cylinder.

FIG. 3 illustrates, in the form of a flowchart for a four-cylinder engine, a method for determining the correction values, necessary for cylinder equalization, for the metering of fuel for each individual cylinder. In this context, after the start of the internal combustion engine (BKM) the heater of each of the fuel injectors is operated with the previously calculated standardized heating power $P_{1\ldots4stand}$. On the basis of knowledge of the fuel forward run temperature $T_{in}$, the temperature-measuring functionality of the respective heater determines the increase in temperature $\Delta T$, brought about by the heating process, of the fuel flowing through the fuel injector. On the basis of this increase in temperature $\Delta T$ which is determined individually for each fuel injector, the mass flow dm/dt of fuel which flows through the respective fuel injector is determined taking into account equation (6).

Then, an average fuel mass flow $dm_{1\ldots4avg}/dt$ is calculated from the individual fuel mass flows $dm_{1\ldots4}/dt$. On the basis of the individual fuel mass flows $dm_{1\ldots4}/dt$ and the calculated average fuel mass flow $dm_{1\ldots4avg}/dt$, a correction value $dm_{1\ldots4_corr}/dt$ is then determined for each fuel injector. This correction value $dm_{1\ldots4_corr}/dt$ is then used to actuate the individual fuel injectors in a modified fashion (in particular by adapting the opening times and/or closing times of the respective fuel injector), with the result that the individual cylinders of the internal combustion engine are at least approximately equalized with respect to their fuel mass fed in.

At this point, it is to be noted that the quantity correction illustrated in FIG. 3 can in practice preferably take place in the form of a control loop which is repeated continuously.

The invention claimed is:

1. A method for determining a quantity of fuel flowing through a fuel injector, the fuel injector having an electric heating device for heating the fuel and a temperature-measuring device for measuring a temperature of the heated fuel, the method comprising:

closing the fuel injector;

measuring, with the temperature-measuring device, the temperature of the fuel located in the fuel injector;

feeding in, with the fuel injector closed, a predefined test heating power until the measured temperature of the fuel located in the fuel injector has reached a predefined setpoint temperature;

measuring a time period that is required to reach the predefined setpoint temperature at the predefined test heating power; and determining an electrical heating power for a fuel injector of the internal combustion engine on the basis of the measured time period, where said electrical heating power is determined to be higher or lower based on longer or shorter measured time periods;

applying the electrical heating power to the electric heating device;

measuring an increase in the temperature of the fuel caused by the heating power; and determining the quantity of fuel flowing through the fuel injector from the electrical heating power applied to the electric heating device and the measured increase in the temperature of the fuel and adjusting the quantity of fuel flowing through the fuel injector based on the previously determined quantity of fuel.

2. The method according to claim 1, which comprises measuring the increase in the temperature of the fuel by way of the electric heating device.

3. A method for equalizing a feeding of fuel in at least two cylinders of an internal combustion engine, the method comprising:

carrying out the method according to claim 1 for each fuel injector respectively assigned to a cylinder of the internal combustion engine; and balancing the feeding of fuel based on the quantities of fuel determined by the method.

4. The method according to claim 3, wherein the step of balancing the feeding of fuel comprises adapting opening times and/or closing times of the respective fuel injector.

5. The method according to claim 3, also comprising:

determining the electrical heating power for each fuel injector of the internal combustion engine, so as to cause a thermal heating power that is transferred to the fuel in case of a specific fuel mass flow through the respective fuel injector, to be equal for all the fuel injectors.

6. The method according to claim 5, which comprises determining the electrical heating power for each fuel injector of the internal combustion engine at a time after the internal combustion engine was not operational for at least one specific rest time period.

7. The method according to claim 5, which comprises adjusting the predefined test heating power to a specific value.

8. An engine controller for an internal combustion engine, the engine controller being configured to execute the method according to claim 1 for determining a quantity of fuel flowing through a fuel injector of an internal combustion engine.

9. An engine controller for an internal combustion engine, the engine controller being configured to execute the method according to claim 3 for equalizing a fuel feed into two or more cylinders of an internal combustion engine.

10. A non-transitory computer program product comprising a computer program for determining a quantity of fuel flowing through a fuel injector, wherein the computer program, when executed by a processor, is configured to carry out the method according to claim 1.

* * * * *